US011701698B1

(12) United States Patent
Lee

(10) Patent No.: US 11,701,698 B1
(45) Date of Patent: Jul. 18, 2023

(54) SYSTEMS, APPARATUSES, AND METHODS FOR BENDING A THERMOCOUPLE TUBE

(71) Applicant: Cryoport, Inc., Brentwood, TN (US)

(72) Inventor: Ben Lee, Corona, CA (US)

(73) Assignee: Cryoport, Inc., Brentwood, TN (US)

( * ) Notice: Subject to any disclaimer, the term of this patent is extended or adjusted under 35 U.S.C. 154(b) by 0 days.

(21) Appl. No.: 17/726,492

(22) Filed: Apr. 21, 2022

(51) Int. Cl.
*B21D 9/01* (2006.01)

(52) U.S. Cl.
CPC ..... *B21D 9/01* (2013.01)

(58) Field of Classification Search
CPC .. B21D 9/01; B21D 7/02; B21D 7/024; B25B 5/166
See application file for complete search history.

(56) References Cited

U.S. PATENT DOCUMENTS 3,789,640 A * 2/1974 Frank ..... B21D 7/063 D8/32
6,102,912 A * 8/2000 Cazin ..... A61B 17/7031 606/279
8,777,953 B1 * 7/2014 Khalili ..... A61B 17/7085 606/86 A
2019/0298428 A1 * 10/2019 Richards ..... B21D 7/063

* cited by examiner

*Primary Examiner* — Teresa M Ekiert
(74) *Attorney, Agent, or Firm* — Snell & Wilmer L.L.P.

(57) ABSTRACT

Systems, apparatuses, and methods to bend a tube at a predetermined location and angle are disclosed herein. An apparatus may have a body and a trigger pivotably attachable to the body. The body may have a female component to retain and prevent unwanted longitudinal movement of the tube towards a bottom of the body and lateral movement of the tube. The trigger may have an arcuate surface that contacts the tube to bend the tube when the trigger is squeezed.

16 Claims, 8 Drawing Sheets

SYSTEMS, APPARATUSES, AND METHODS FOR BENDING A THERMOCOUPLE TUBE

BACKGROUND

1. Field

The various aspects and embodiments described herein relate to manufacturing probes or tubes usable in various applications, particularly systems, apparatuses, and methods for bending the probes or tubes for various purposes.

2. Description of the Related Art

In the health, medical, pharmaceutical, and/or life science industries, storage and transportation of payload in an accurately temperature-controlled environment is important. Thermocouple probes or tubes are placed in environments of shipping containers and dewars that surround payload. Thermocouple probes are generally inserted in tubes, which are often made of stainless steel, disposed in the payload area. In order to prevent the thermocouple probe from coming out of the tube, the thermocouple probe is bent or cambered. The bending or the cambering is generally performed manually by hand. Bending a thermocouple probe by hand may physically damage the thermocouple probe, potentially leading to structural deficiencies and inaccurate temperature readings. Further, bending multiple thermocouple probes may not result in all thermocouple probes being bent uniformly. Thermocouple probes that are bent differently may result in variability in various aspects.

As such, there is a need for systems, apparatuses, and methods for bending thermocouple probes uniformly, safely, and efficiently.

SUMMARY

Systems, apparatuses, and methods to bend a tube at a predetermined location and angle are disclosed herein. The tube may be a metal tube used in various, often industrial (e.g., welding, machinery building, etc.), applications or a thermocouple probe used to measure and monitor a temperature of a subject. For example, a thermocouple probe may be used in shipping containers and dewars configured to maintain their payload areas at a desired temperature using cryogenic liquids or phase-change materials to ensure the temperature of the payload area is the desired temperature or within a desired temperature range. Bending the thermocouple probe may ensure that it is retained within its housing located in the payload area.

In one aspect, the disclosure is embodied in an apparatus configured to bend a tube at a predetermined location and angle. The apparatus has a body. The body has a female component to retain and prevent unwanted longitudinal movement of the tube towards a bottom of the body and lateral movement of the tube. The apparatus further has a trigger. The trigger is pivotably attachable to the body. The trigger has an arcuate surface that contacts the tube to bend the tube when the trigger is squeezed.

These and other embodiments may optionally include one or more of the following features. The tube may be a thermocouple probe. The trigger may be loaded by a spring. The spring may be biased against the body. The female component may be a chamber. The chamber may have an open top end to receive the tube and a closed bottom end to prevent unwanted longitudinal movement of the tube towards the bottom of the body. The trigger may define a hole to receive the tube to further prevent lateral movement of the tube. The hole may be laterally aligned with the chamber. The body may define an aperture near the bottom end of the chamber to monitor a position of the tube relative to the bottom end.

The body may have a handle portion to hold the apparatus. The handle portion may define a plurality of grooves. Each of the plurality of grooves may be shaped and sized to receive a finger. The handle portion may have a first length and the trigger may have a second length. The first length may be greater than the second length.

In another aspect, the disclosure is embodied in a system. The system includes a metal tube. The system further includes an apparatus. The apparatus has a body. The body has a chamber to retain and prevent unwanted longitudinal movement of the metal tube towards a bottom of the body and lateral movement of the metal tube. The apparatus further has a trigger. The trigger is pivotably attachable to the body. The trigger has an arcuate surface that contacts the metal tube to bend the tube at a predetermined location and angle when the trigger is squeezed.

These and other embodiments may optionally include one or more of the following features. The metal tube may be a thermocouple probe. The trigger may be loaded by a spring. The spring may be biased against the body. The chamber may have an open top end to receive the metal tube and a closed bottom end to prevent unwanted longitudinal movement of the metal tube towards the bottom of the body. The trigger may define a hole to receive the metal tube to further prevent lateral movement of the metal tube. The hole may be laterally aligned with the chamber. The body may define an aperture near the bottom end of the chamber to monitor a position of the metal tube relative to the bottom end.

The body may have a handle portion to hold the apparatus. The handle portion may define a plurality of grooves. Each of the plurality of grooves may be shaped and sized to receive a finger. The handle portion may have a first length. The trigger may have a second length. The first length may be greater than the second length.

In yet another aspect, the disclosure is embodied in a method for bending a tube. The method includes inserting the tube into a chamber of a body of an apparatus until an end of the tube contacts a bottom end of the chamber. The method further includes squeezing a trigger pivotably attached to the body until an arcuate surface of the trigger contacts and bends the tube at a predetermined angle.

These and other embodiments may optionally include one or more of the following features. The method may further include inserting the tube through a hole defined by the trigger and laterally aligned with the chamber prior to inserting the tube into the chamber to prevent lateral movement of the metal tube. The method may further include looking through an aperture located near the bottom end of the chamber to monitor a position of the tube relative to the bottom end prior to squeezing the trigger. The method may further include engaging a plurality of fingers with a plurality of grooves defined by a handle portion of the body to hold the apparatus prior to squeezing the trigger.

BRIEF DESCRIPTION OF THE DRAWINGS

Other apparatus, methods, features, and advantages of the present disclosure will be apparent to one skilled in the art upon examination of the following figures and detailed description. Component parts shown in the drawings are not necessarily to scale and may be exaggerated to better illustrate the important features of the present disclosure.

DETAILED DESCRIPTION

Disclosed herein are systems, apparatuses, and methods for bending a tube at a predetermined location and angle. The tube may be metal, such as stainless steel, and used in various, often industrial, applications, such as in welding when defined bends are needed and in machinery building. Particularly, the tube may be a thermocouple probe used to measure and monitor a temperature of a subject. For example, a thermocouple probe may be used in shipping containers and dewars that store and transport temperature-sensitive payloads. These shipping containers and dewars may be configured to maintain their payload areas at a desired temperature using cryogenic liquids (e.g., liquid nitrogen) or phase-change materials (e.g., dry ice) to ensure that the temperature of the payload area is the desired temperature or within a desired temperature range. Thermocouple probes may be housed in tubes that are located inside a payload area. Bending the thermocouple probe may ensure that it is retained within the housing tube located in the payload area. The systems, apparatuses, and methods described herein advantageously bend the thermocouple probe consistently at a predetermined location and angle without damaging the thermocouple probe physically and electrically. Hence, thermocouple bends provided by these systems, apparatuses, and methods are uniform and conserve resources.

Figure 1:
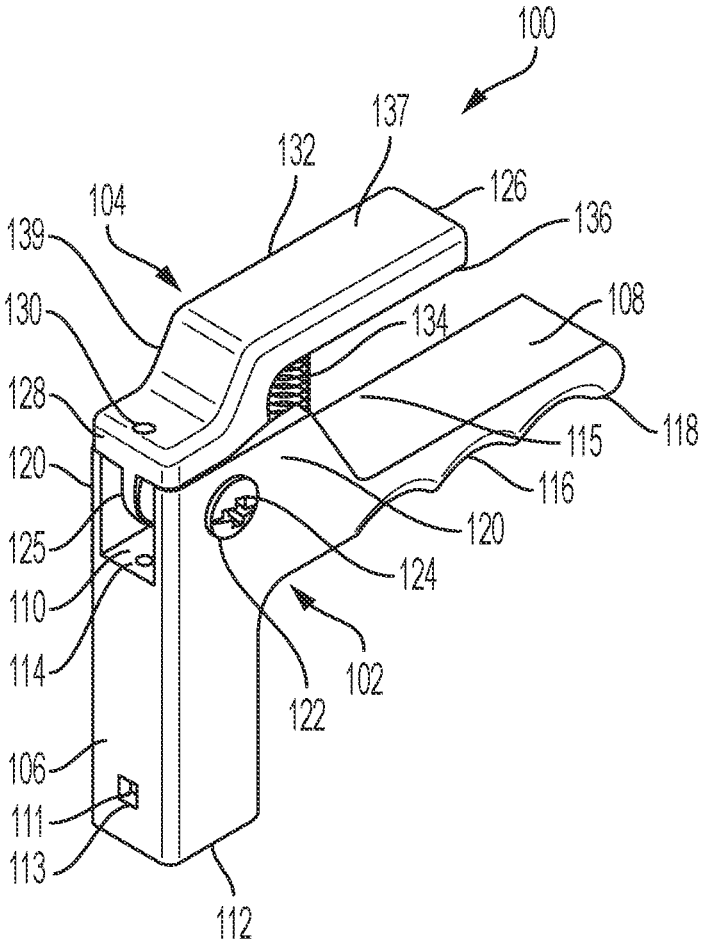
FIG. 1 shows a front perspective view of an apparatus configured to bend a tube according an aspect of the present disclosure.

FIG. 1 shows a front perspective view of an apparatus 100 configured to bend a tube. The apparatus 100 may have the appearance of a pistol, a garden hose nozzle, or a faucet. The apparatus 100 may be generally L-shaped. The apparatus 100 may have a body 102. The apparatus 100 may further have a trigger 104 attachable to the body 102. The trigger 104 may be squeezed or activated to bend a tube inserted into the apparatus 100.

The body 102 may have an L-shape. The body 102 may be made from a polymer, a metal, or wood. The body 102 may be manufactured via molding, casting, or additive manufacturing (e.g., 3-D printing). The body 102 may have a vertical portion 106 and a horizontal portion or a handle portion 108. The handle portion 108 and the vertical portion 106 may be perpendicular to each other. While called a "vertical portion" herein, one may appreciate that the body 102 may be held in a variety of orientations. As used herein, a "vertical portion" may also be called a first portion and a "handle portion" may be called a second portion. The second portion may extend generally outwardly from the first portion. For instance, the first portion and second portion may be joined at an angle. The first portion and second portion may be joined at corresponding ends of the first portion and the second portion. The first portion and the second portion may be joined at an about perpendicular angle at corresponding ends of the first portion and the second portion. In this manner, the first portion and the second portion (the vertical portion 106 and the handle portion 108) may be perpendicular and/or may form an L-shape.

The vertical portion 106 may have a rectangular prism or a cylindrical structure by example. The vertical portion 106 may have another structure with less or more sides than a rectangular prism. The vertical portion 106 may have a female component to retain the tube. The female component may be a chamber, a bore, a hole, a cavity, a ring, and the like. FIG. 1 shows a chamber 110 by example. The chamber 110 may be defined by a bore that extends down to a base 112 of the vertical portion 106. The bore may be cylindrical. The chamber 110 may be shaped and sized to snugly receive a tube. A bottom end 111 of the chamber 110 may be visible through an aperture 113 on the vertical portion 106. The aperture 113 may allow monitoring a position of the tube relative to the bottom end 111 prior to squeezing the trigger. This may ensure that the tube is bent at the desired location. The aperture 113 may be located on any side of the vertical portion 106. The aperture 113 may be square, rectangle, circular, oval, or any other shape. The chamber 110 may have an opening 114 on a top surface 115 of the body 102. The top surface 155 may extend from the vertical portion 106 to the handle portion 108.

The handle portion 108 may define a plurality of grooves 116. Three grooves 116 are shown in FIG. 1 by example. In some embodiments, there may be less or more grooves 116. Each of the grooves 116 may be shaped and sized to receive a user's finger. The grooves 116 may be on the top surface 115 and/or a bottom surface 118 of the handle portion 108. In FIG. 1, only the bottom surface 118 has grooves 116. The handle portion 108 may be made from or coated with a grippy material to prevent or mitigate slippage. Alternatively or additionally, the handle portion 108 may have a rough surface to improve grip.

The body 102 may have a pair of walls 120 extending vertically up and away from the top surface 115. The walls 120 may mirror each other. The walls 120 may each have a female component or a hole 122 to fasten the trigger 104 to the body 102. A screw 124 or a similar fastener may go through both holes 122 and the trigger 104 to fasten the trigger 104 to the body 102. The trigger 104 may pivot about the screw 124. Portions of the trigger 104 that the screw 124 is inserted through may define an arcuate surface 125. The arcuate surface 125 may contact the tube and bend or camber it when the trigger 104 is squeezed.

The trigger 104 may be made from a polymer, a metal, or wood. The trigger 104 may be manufactured via molding, casting, or additive manufacturing (e.g., 3-D printing). The trigger 104 may be made from the same material as the body 102. The trigger 104 may have a proximal end 126 and a distal end 128. The trigger 104 may define a hole 130 near the distal end 128. The hole 130 may be laterally aligned with the chamber 110. As such, a tube may be inserted straight down, without bending, into the hole 130 first and then the chamber 110. Similarly, the tube may be inserted straight down, without bending, into the chamber 110 first and then the hole 130. The hole 130 may support the tube from the top and further prevent lateral movement of the tube. The trigger 104 may have a raised portion 132. The raised portion 132 may provide enough clearance for a spring 134 to be disposed between the trigger 104 and the body 102. The trigger 104 may be loaded by the spring 134. The spring 134 may be fastened to a lower surface 136 of the trigger 104 from one end and the top surface 115 of the body 102 from another end. An upper surface 137 on an opposing side of the lower surface 136 may be etched to indicate a brand, model, serial number, or other information as shown in FIG. 1. There may be a sloped portion 139 between the distal end 128 and the raised portion 132.

Figure 2:
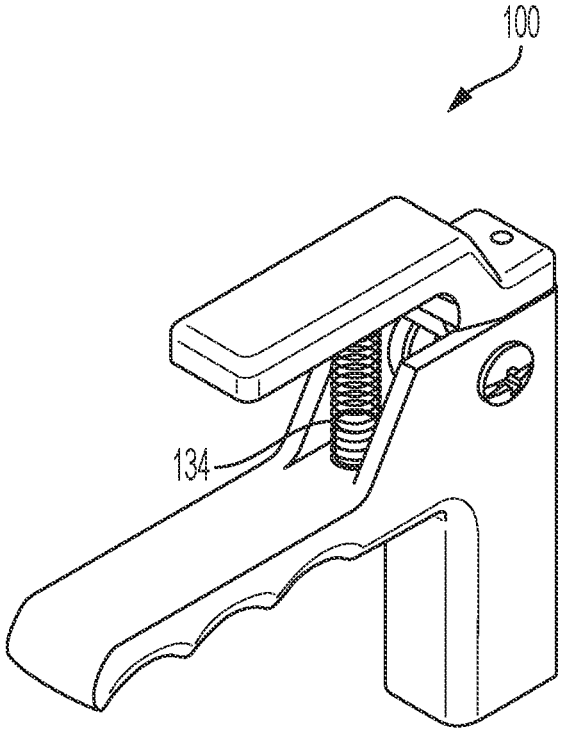
FIG. 2 shows a rear perspective view of the apparatus of FIG. 1 according to an aspect of the present disclosure.

FIG. 2 shows a rear perspective view of the apparatus 100. The spring 134 may be a conventional spring made of metal or plastic. Bends of the spring 134 may be angled or straight. In some embodiments, the spring 134 may be replaced with a pneumatic, a hydraulic, or a motorized mechanism that allows for the trigger 104 to be squeezed and retract after the trigger 104 is let go.

Figure 3:
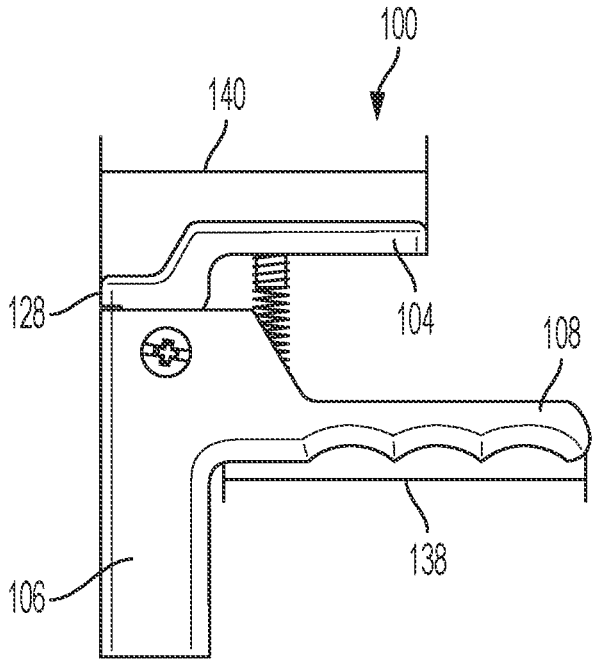
FIGS. 3 and 4 show side views of the apparatus of FIG. 1 according to an aspect of the present disclosure.

FIG. 3 shows a side view of the apparatus 100. The distal end 128 of the trigger 104 may be flush with at least one side of the vertical portion 106. The handle portion 108 may have a first length 138. The trigger 104 may have a second length 140. The first length 138 may be greater than the second length 140. The second length 140 being shorter than the first length 138 may make squeezing the trigger 104 and using the apparatus 100 more user-friendly. For instance, the apparatus 100 may be held and used with a single hand. A user's thumb may be placed on the trigger 104 to squeeze the trigger 104 while the other fingers wrap around the handle portion 108. A plurality of a user's fingers may at least partially wrap around a combination of the trigger 104 and the handle portion 108 to squeeze the trigger while the user closes the user's hand. The second length 140 being shorter may increase the angle the trigger 104 can pivot, thereby providing an effective bend to an appropriate angle.

Figure 4:
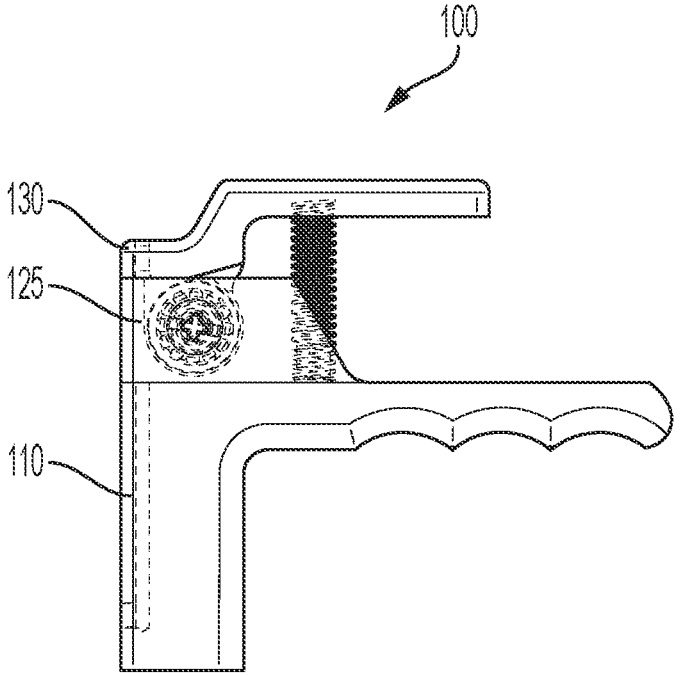

FIG. 4 shows another side view of the apparatus 100. The chamber 110 is shown in dashed lines. The hole 130 is also shown in dashed lines. The chamber 110 and the hole 130 may have the same size or diameter. The chamber 110 and the hole 130 may create a clear path for a tube to be inserted. Once a tube is inserted through the hole 130 and the chamber 110, the snug fitment of the tube may prevent the tube from moving laterally. The arcuate surface 125 is also shown in dashed lines. Thus, the position of the arcuate surface 125 in relation to the chamber 110 and the hole 130 may be observed in FIG. 4. In various embodiments, the hole 130 and the chamber 110 are aligned with the arcuate surface 125 so that a line corresponding to a side of the hole 130 and a side of the chamber 110 is also a tangent line of the arcuate surface 125. Thus, one may appreciate that a side of a tube inserted through the hole 130 and chamber 110 may be oriented tangent to the arcuate surface 125. In various instances, the side of the tube contacts the arcuate surface 125 while in further instances, the side of the tube is spaced away from the arcuate surface 125.

Figure 5:
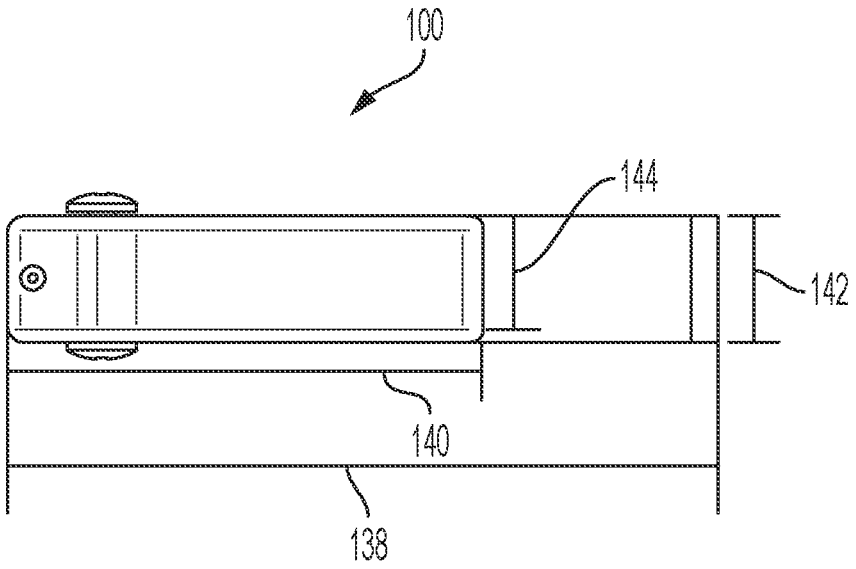
FIG. 5 shows a top view of the apparatus of FIG. 1 according to an aspect of the present disclosure.

FIG. 5 shows a top view of the apparatus 100. The difference between the first length 138 and the second length 140 may be observed in FIG. 5. The first length 138 and the second length 140 may both be greater than a first thickness 142 of the handle portion 108 and a second thickness 144 of the trigger 104. The first thickness 142 and the second thickness 144 may be equal. In some embodiments, the second thickness 144 may be less than the first thickness 142.

Figure 6:
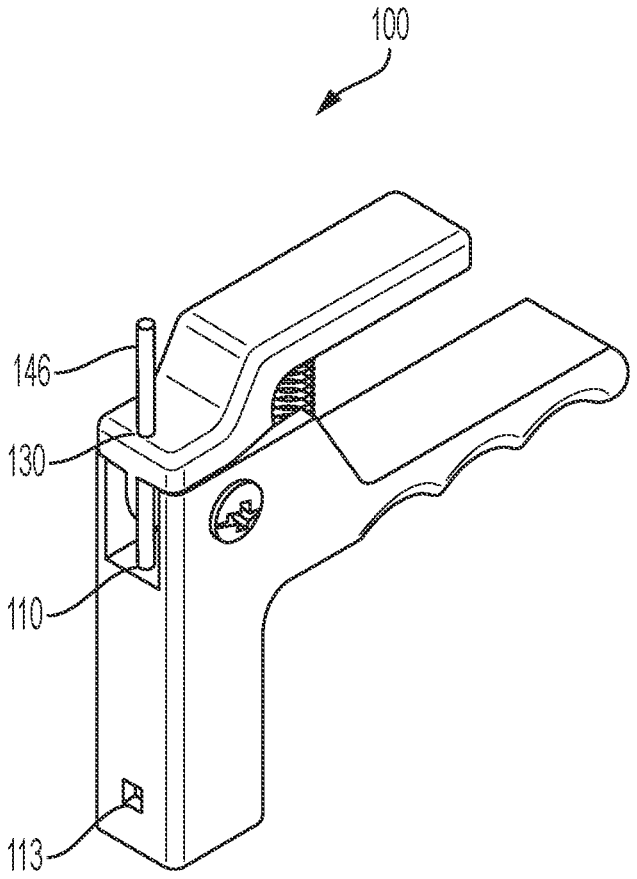
FIG. 6 shows a front perspective view of the apparatus of FIG. 1 with a tube inserted in a chamber of the apparatus according to an aspect of the present disclosure.

FIG. 6 shows a front perspective view of the apparatus 100 with a tube 146 inserted in the chamber 110. The tube 146 may be cylindrical or another shape. The tube 146 may be made from plastic or metal. The tube 146 may be vertically straight prior to being bent. The tube 146 may be a thermocouple probe. The tube 146 may be configured to receive a thermocouple probe to be disposed inside the tube 146. The thermocouple probe may measure temperature of its surroundings. The thermocouple probe may be electronically coupled to a device that may display and/or store temperature readings. The tube 146 may be inserted into the hole 130 first and then the chamber 110. The tube 146 may be pushed down until it is visible through the aperture 113 and/or can no longer be pushed down. For instance, the tube may be inserted until an end of the tube contacts a bottom end 111 of the chamber 110. Thus, the apparatus 100 consistently registers the tube 146 at a consistent orientation so that bends in multiple tubes 146 have a same location along a length of the tubes and a same bend angle and a same bend radius.

Figure 7A:
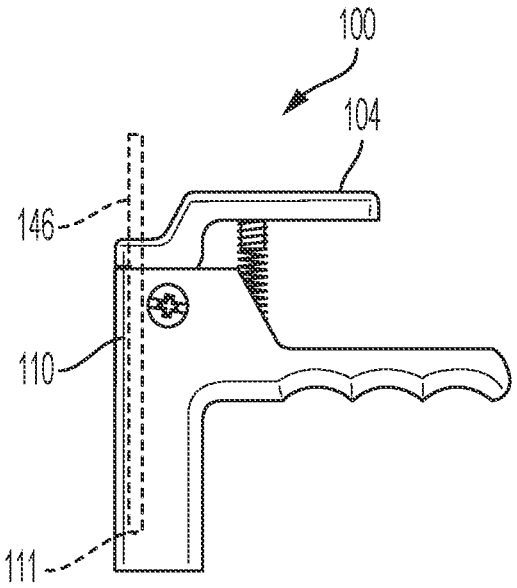
FIG. 7A shows a side view of the apparatus of FIG. 6 according to an aspect of the present disclosure.
Figure 7B:
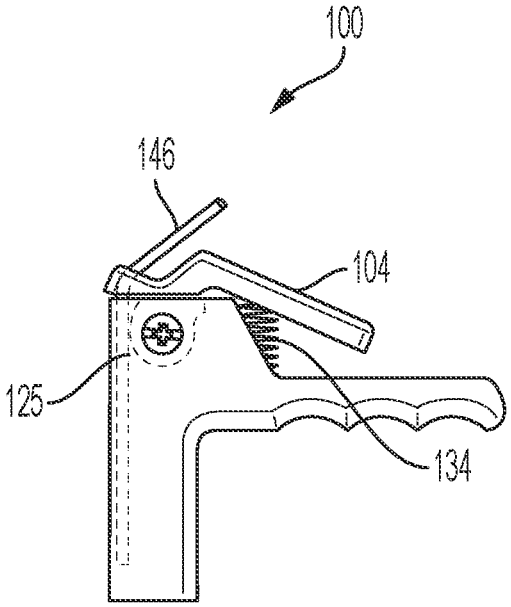
FIG. 7B shows a side view of the apparatus of FIG. 6 having a squeezed trigger according to an aspect of the present disclosure.

FIG. 7A shows a side view of the apparatus 100. The tube 146 is shown in dashed lines and inserted into the apparatus 100. The tube 146 is shown as vertically straight as the trigger 104 has not been squeezed yet. FIG. 7B shows a side view of the apparatus 100 with the trigger 104 squeezed. When the trigger 104 is squeezed, the tube 146 may be pulled towards the arcuate surface 125 and bent. The spring 134 may be at a depressed state when the trigger 104 is squeezed. The trigger 104 may be squeezed until it can no longer move so that the angle of the bend is consistent with the predetermined desired angle. For example, the angle may be between 5 and 89 degrees. Preferably, the angle may be between 10 and 30 degrees. Most preferably, the angle may be 15 degrees. The arcuate surface 125 may be sized based on the desired bend angle. The tube 146 may be removed from the apparatus 100 following the bending.

Figure 8:
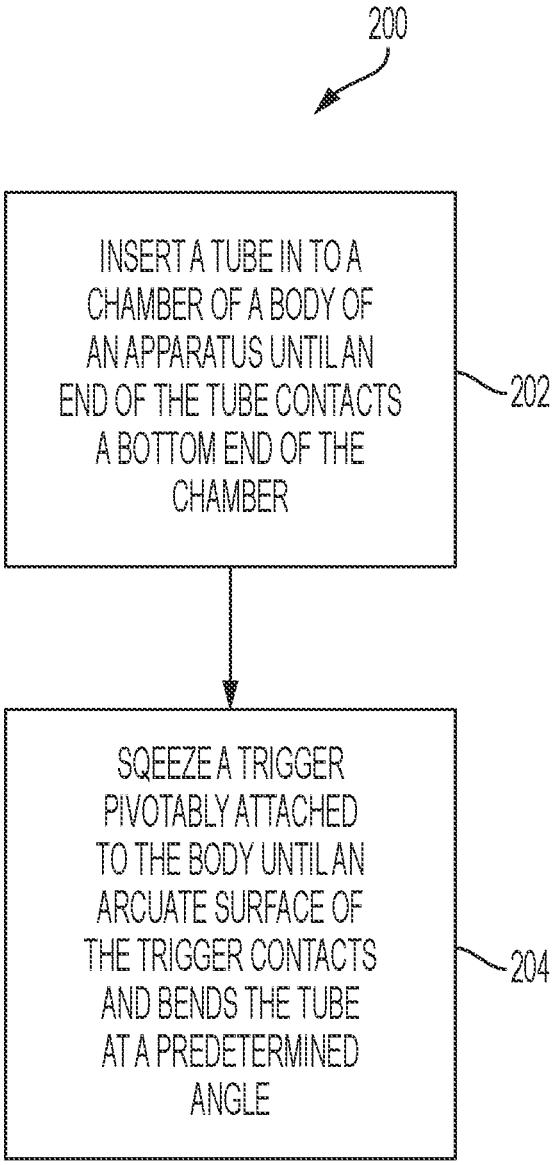
FIG. 8 shows a flow diagram of a method for bending a tube according to an aspect of the present disclosure.

FIG. 8 shows a flow diagram of a method 200 for bending a tube 146 (see FIG. 6). The method 200 may begin with block 202. In block 202, the method 200 may include inserting the tube into a chamber of a body of an apparatus until an end of the tube contacts a bottom end of the chamber (see FIG. 7A). In block 204, the method 200 may include squeezing a trigger that is pivotably attached to the body until an arcuate surface of the trigger contacts and bends the tube at a predetermined angle (see FIG. 7B).

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An apparatus configured to bend a tube at a predetermined location and angle comprising:

a body having a female component to retain and prevent unwanted longitudinal movement of the tube towards a bottom of the body and lateral movement of the tube; and a trigger pivotably attachable to the body and having an arcuate surface that contacts the tube to bend the tube when the trigger is squeezed, wherein the trigger is loaded by a spring, the spring being biased against the body.

2. The apparatus of claim 1, wherein the body has a handle portion to hold the apparatus, the handle portion defining a plurality of grooves, each of the plurality of grooves shaped and sized to receive a finger.

3. The apparatus of claim 2, wherein the handle portion has a first length and the trigger has a second length, the first length being greater than the second length.

4. An apparatus configured to bend a tube at a predetermined location and angle comprising:

a body having a female component to retain and prevent unwanted longitudinal movement of the tube towards a bottom of the body and lateral movement of the tube; and a trigger pivotably attachable to the body and having an arcuate surface that contacts the tube to bend the tube when the trigger is squeezed, wherein the female component is a chamber having an open top end to receive the tube and a closed bottom end to prevent unwanted longitudinal movement of the tube towards the bottom of the body.

5. The apparatus of claim 4, wherein the trigger defines a hole to receive the tube to further prevent lateral movement of the tube, the hole being laterally aligned with the chamber.

6. The apparatus of claim 4, wherein the body defines an aperture near the bottom end of the chamber to monitor a position of the tube relative to the bottom end.

7. A system comprising:

a metal tube; and an apparatus comprising:

a body having a chamber to retain and prevent unwanted longitudinal movement of the metal tube towards a bottom of the body and lateral movement of the metal tube; and a trigger pivotably attachable to the body and having an arcuate surface that contacts the metal tube to bend the tube at a predetermined location and angle when the trigger is squeezed, wherein the trigger is loaded by a spring, the spring being biased against the body.

8. A system comprising:

a metal tube; and an apparatus comprising:

a body having a chamber to retain and prevent unwanted longitudinal movement of the metal tube towards a bottom of the body and lateral movement of the metal tube, and a trigger pivotably attachable to the body and having an arcuate surface that contacts the metal tube to bend the tube at a predetermined location and angle when the trigger is squeezed, wherein the chamber has an open top end to receive the metal tube and a closed bottom end to prevent unwanted longitudinal movement of the metal tube towards the bottom of the body.

9. The system of claim 8, wherein the trigger defines a hole to receive the metal tube to further prevent lateral movement of the metal tube, the hole being laterally aligned with the chamber.

10. The system of claim 8, wherein the body defines an aperture near the bottom end of the chamber to monitor a position of the metal tube relative to the bottom end.

11. The system of claim 8, wherein the body has a handle portion to hold the apparatus, the handle portion defining a plurality of grooves, each of the plurality of grooves shaped and sized to receive a finger.

12. The system of claim 11, wherein the handle portion has a first length and the trigger has a second length, the first length being greater than the second length.

13. A method for bending a tube comprising:

inserting the tube into a chamber of a body of an apparatus until an end of the tube contacts a bottom end of the chamber; and squeezing a trigger pivotably attached to the body until an arcuate surface of the trigger contacts and bends the tube at a predetermined angle.

14. The method of claim 13, further comprising inserting the tube through a hole defined by the trigger and laterally aligned with the chamber prior to inserting the tube into the chamber to prevent lateral movement of the metal tube.

15. The method of claim 13, further comprising looking through an aperture located near the bottom end of the chamber to monitor a position of the tube relative to the bottom end prior to squeezing the trigger.

16. The method of claim 13, further comprising engaging a plurality of fingers with a plurality of grooves defined by a handle portion of the body to hold the apparatus prior to squeezing the trigger.

* * * * *